US010325481B2

(12) United States Patent
Kriete et al.

(10) Patent No.: US 10,325,481 B2
(45) Date of Patent: Jun. 18, 2019

(54) BUILDING DEVICE HAVING AN ADDRESS PROGRAMMING INTERFACE

(71) Applicant: Siemens Schweiz AG, Zurich (CH)

(72) Inventors: Richard Kriete, Hazlet, NJ (US); Stavros Zavros, Succasunna, NJ (US); Anthony Pascale, N. Plainfield, NJ (US)

(73) Assignee: Siemens Schweiz AG, Zurich (CH)

( * ) Notice: Subject to any disclaimer, the term of this patent is extended or adjusted under 35 U.S.C. 154(b) by 119 days.

(21) Appl. No.: 15/720,339

(22) Filed: Sep. 29, 2017

(65) Prior Publication Data

US 2019/0103014 A1 Apr. 4, 2019

(51) Int. Cl.

| | |
|---|---|
| ***G08B 25/12*** | (2006.01) |
| ***H01H 9/02*** | (2006.01) |
| ***H01H 1/38*** | (2006.01) |

(52) U.S. Cl.

CPC ..... *G08B 25/12* (2013.01); *H01H 1/38* (2013.01); *H01H 9/0264* (2013.01); *H01H 9/0271* (2013.01)

(58) Field of Classification Search

CPC ..... G08B 25/12; H01H 1/38; H01H 9/0264; H01H 9/0271

See application file for complete search history.

(56) References Cited

U.S. PATENT DOCUMENTS 5,719,363 A * 2/1998 Handler ..... H01H 71/126 200/50.02

* cited by examiner

*Primary Examiner* — Robert L Deberadinis

(57) ABSTRACT

A building device with a front accessible address programming interface is provided. The building device includes a mounting base having front and rear surfaces. The front surface defines two connector channels extending towards the rear surface. The connector channels are spaced apart and sized to each receive a respective prong of a programming device connector plug. The building device further includes external terminals disposed on the rear surface, internal terminals, a group of normally closed switches having a common control input, and an actuator. Each switch connects an external terminal to a respective internal terminal when the common control input is deactivated to provide a network connection. The actuator is connected to the common control input and disposed such that the connector plug engages the actuator to activate the common control input of the switches when each of the connector channels receive a respective prong of the connector plug.

13 Claims, 16 Drawing Sheets

BUILDING DEVICE HAVING AN ADDRESS PROGRAMMING INTERFACE

CROSS REFERENCE TO RELATED APPLICATION

The subject matter of the present application is related to the subject matter in the U.S. patent application Ser. No. 15/720,282, titled "Alarm Pull Station Having A Removable Actuator Cover,". This related application was filed on the same day as the present application by one or more of the same inventors as the present application and commonly assigned herewith to Siemens Schweiz AG. The entirety of this related application is incorporated herein by reference to the extent permitted by law.

TECHNICAL FIELD

The present disclosure is directed, in general, to network addressable building safety and automation devices and, more particularly, to a building device such as a fire alarm pull station having an address programming interface.

BACKGROUND OF THE DISCLOSURE

Building automation systems encompass a wide variety of systems that aid in the monitoring and control of various aspects of building operation. Building safety and automation systems include fire safety systems, security systems, lighting systems, and HVAC systems. Each of these systems may have a control panel or station that communicates over a network with network addressable devices or terminal equipment ("Building Devices").

The unique communication address of such a conventional addressable Building Device is typically manually set using a dip switch or may be preprogrammed in a memory of the device during factory manufacturing of the device as disclosed in U.S. Pat. No. 6,693,529 for use in a fire alarm system. As disclosed in U.S. Pat. No. 6,693,529, a factory preprogrammed device may have its address in memory changed based on a command message transmitted from a control panel after the Building Device is installed. But dip switches, fixed rotary switches or other types of switches located within a Building Device are not often easily accessible once the Building Device has already been installed on a wall or ceiling. Moreover, reprogramming the Building Device using a control panel requires the network connection to the Building Device to be complete and operational, which does not allow for convenient or cost effective installation of such devices, for example, for a fire alarm system.

U.S. Pat. No. 9,619,125 discloses that a mobile programming device may be used to wirelessly communicate with a notification safety device (i.e., one type of Building Device) in a fire alarm system to program the address of such notification device after installation but prior to establishing network communication with a fire panel. However, such an arrangement requires the safety device to have a wireless interface that may be expensive and be programmed to be responsive to a corresponding mobile programming device.

Certain conventional addressable Building Devices have address programming limitations once the device is electrically connected to a network and installed on a building wall or other infrastructure since the electrical connections are not exposed for access after installation. For example, conventional addressable manual pull stations are affixed to vertical building walls by attachment to a standard single or double gang electrical switch box located on the wall. The pull station is attached to the box by using standard mounting screws. Electrical connections (i.e., for data communication over power lines) between the pull station and fire panel are made via screw terminals located on the rear of the pull station device. Address programming of the pull stations is accomplished by connecting a device programming unit (DPU) such as available from Siemens Industry, Inc., Building Technologies Division, to the pull station via network terminal connections accessible from the back of the pull station. The pull station is typically programmed with a unique address before connecting to the fire panel and mounting the pull station to the wall box.

However, in order to change the address of such a conventional addressable pull station after installation, the door that serves as the alarm actuator has to be opened to access the mounting screws, and the pull station has to be removed from the wall to gain access to the network terminal connections. The power/network wiring to the network terminal connections on the conventional addressable pull station must then be disconnected. The programming device (DPU) can then be connected via a plug or other type of connector to the network terminal connections of the pull station. However, depending on the loop configuration of the power/network wiring, this procedure is disruptive since it stops the operation of some or all other devices connected on that branch of the fire panel. Furthermore, the opening of the pull station door causes a fire alarm to be initiated by a corresponding fire control panel that does not have a means to otherwise discriminate between a normal activation by the pull station and maintenance or address reprogramming condition. Moreover, resetting an activated pull station also requires that the door that functions as the alarm actuator to be opened.

Accordingly, there is a need for an improvement in pull stations or other Building Devices in a fire safety system or building automation system that addresses the foregoing problems, including enabling address programming of such a device after installation without having to remove the device from the wall or other building infrastructure on which it was installed, having to manually disconnect the device from the power/network terminal connections before connecting it to a PDU, inhibiting initiating a fire alarm upon opening the door or actuator of a pull station type Building Device, eliminating need to open the door or actuator to reset such a pull station, and providing means to signal to a fire control panel to distinguish between a normal fire alarm condition from a maintenance or address programming condition.

SUMMARY OF THE DISCLOSURE

Various disclosed embodiments relate to building devices, including fire safety devices such as a manual pull station, that have an address programming interface for programming the building device from the front or back.

Disclosed embodiments provide a building device that comprises a mounting base, a plurality of external terminals, a plurality of internal terminals, a first plurality of normally closed switches having a common control input, and an actuator. The mounting base has a front surface and a rear surface. The front surface defines a plurality of connector channels extending towards the rear surface of the base. The mounting also has a first and a second of the connector channels spaced apart and sized to each receive a respective prong of a connector plug attached to a programming device. The plurality of external terminals are disposed on the rear surface of the mounting base. The first plurality of normally closed switches has a common control input. Each switch of the first plurality of switches connects a respective one of the external terminals to a respective one of the internal terminals when the common control input is deactivated. The actuator is connected to the common control input and disposed in proximity of the connector channels such that the connector plug engages the actuator to activate the common control input of the first plurality of normally closed switches when the first and the second connector channels each receive a respective prong of the connector plug.

The foregoing has outlined rather broadly the features and technical advantages of the present disclosure so that those skilled in the art may better understand the detailed description that follows. Additional features and advantages of the disclosure will be described hereinafter that form the subject of the claims. Those of ordinary skill in the art will appreciate that they may readily use the conception and the specific embodiment disclosed as a basis for modifying or designing other structures for carrying out the same purposes of the present disclosure. Those skilled in the art will also realize that such equivalent constructions do not depart from the spirit and scope of the disclosure in its broadest form.

Before undertaking the DETAILED DESCRIPTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

FIGS. 1A through 15, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device or system.

Embodiments of the present disclosure include improved Building Devices in a fire safety system or building automation system, including fire safety devices such as a manual fire alarm pull station, that have an address programming interface that is accessible from the front or back of the Building Device. Disclosed embodiments also provide that the improved Building Devices that are manual fire alarm pull stations may have a removable actuator cover to facilitate access to the address programming interface from the front or back of the pull station. Disclosed embodiments further provide that manual alarm pull stations may include an actuator switch operatively coupled to the actuator cover to signal when the pull station is a normal state, an alarm mode, or a maintenance mode corresponding to when the cover has been removed.

Figure 1A:
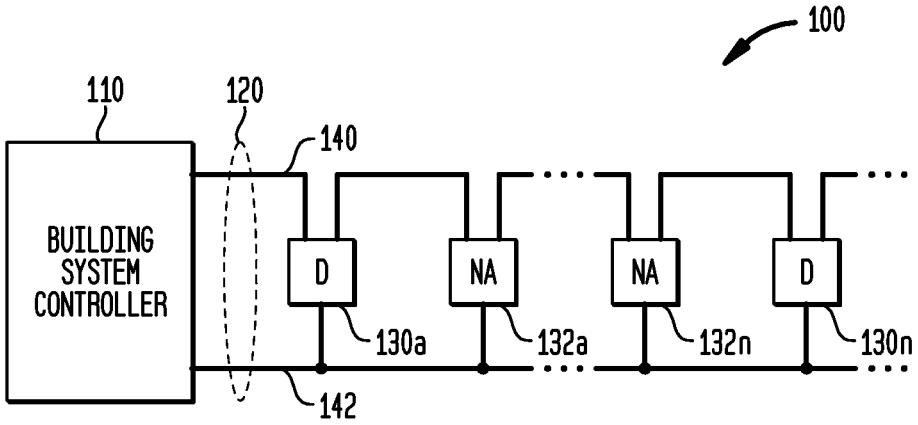
FIG. 1A illustrates a block diagram of a building system in which various embodiments are implemented, where building devices are wired to a network in the other building system in accordance with an isolator operational mode.

FIG. 1A illustrates a block diagram of a building system 100, such as a fire safety system or building automation system, in which various embodiments of Building Devices are implemented. In this illustrative embodiment, the building system 100 includes a building system controller 110, such as a fire safety system panel or building automation system controller and one or more networks 120 of Building Devices 130*a-n* and 132*a-n* that include an addressable programming interface as described herein. In the embodiment shown in FIG. 1A, the Building Devices 130*a-n* may be alarm condition detectors (also referenced as "D" in FIG. 1A) that are monitored by the system controller 110, such as smoke detectors or manual fire alarm pull stations embodying aspects of the present invention. When an alarm condition is sensed, the system controller 110 signals the alarm, via the network 120, to the appropriate Building Devices 132*a-n*, such as an addressable notification appliance (also referenced as "NA" in FIG. 1A).

As shown, all of the Building Devices 130*a-n* and 132*a-n* are coupled across a pair of communication lines 140 and 142 of the network 120, which may be power lines that also carry communications between the system controller 120 and the Building Devices 130*a-n* and 132*a-n*. As described in detail herein, the Building Devices 130*a-n* and 132*a-n* may have an address programming interface that enables the respective Building Device to be programmed with an address after installation but without disabling communication between the system controller 120 and other Building Devices on the network 120. Note, although the Building Devices 132*a-n* are depicted in FIG. 1A as notifications appliances on the same loop circuit or network 120 as Building Devices 130*a-n* that are depicted as alarm condition detectors, the notifications appliances employing aspects of the present invention may be disposed on a separate loop circuit or network (i.e., a notification appliance circuit (NAC) network) from the alarm condition detectors.

In the embodiment shown in FIG. 1A, the Building Devices 130*a-n* and 132*a-n* in the building system 100 are wired to a network in the building system in accordance with an isolator operational mode. As further described in detail herein, the Building Devices 130*a-n* and 132*a-n* that operate in the isolator operational mode have three external terminals (e.g., 1204, 1206 and 1208 in FIG. 12) and an network isolator switch or relay (e.g., switch 1436 in FIG. 14 or switch 1536 in FIG. 15). The network isolator switch selectively isolates the respective Building Device (e.g., 130*a*) from a first communication line 140, while allowing the next Building Device (e.g., 132*a*) on the network 120 to remain connected to the first communication line 140.

Figure 1B:
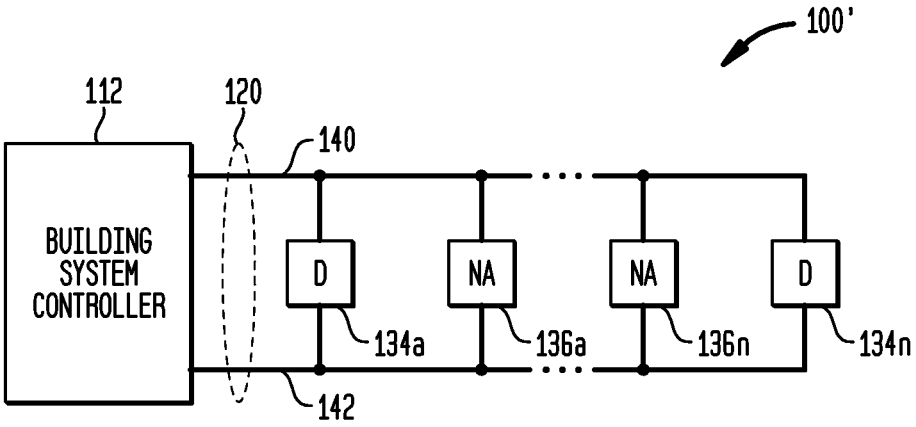
FIG. 1B illustrates a block diagram of another building system in which various embodiments are implemented, where building devices are wired to a network in the building system in accordance with a polarity insensitive operational mode.

FIG. 1B illustrates a block diagram of another building system 100' that is consistent with the building system 100, except the Building Devices 134*a-n* and 136*a-n* are wired to the network 120 and the building system controller 112 in the building system 100' in accordance with a polarity insensitive operational mode. As described in detail herein, the Building Devices 134*a-n* and 136*a-n* may have an address programming interface similar to Building Devices 130*a-n* and 132*a-n* that enables the respective Building Device to be programmed with an address after installation but without disabling communication between the system controller 120 and other Building Devices on the network 120. Note, although the Building Devices 136*a-n* are depicted in FIG. 1B as notifications appliances on the same loop circuit or network 120 as Building Devices 134*a-n* that are depicted as alarm condition detectors, the notifications appliances employing aspects of the present invention may be disposed on a separate loop circuit or network (i.e., a notification appliance circuit (NAC) network) from the alarm condition detectors.

As further described in detail herein, the Building Devices 134*a-n* and 136*a-n* that operate in the polarity insensitive operational mode may have three external terminals (e.g., 1204, 1206 and 1208 in FIG. 12) but only require two terminals (e.g., 1204 and 1206) to couple to the first communication line 140 and second communication line 142, respectively. When operating in polarity insensitive operational mode, each Building Device can still isolate itself from the network via internal switches (e.g., 1420*a*, 1420*b* in FIGS. 14 and 1520*a* and 1520*b* in FIG. 15) while other Building Devices (e.g., 134*a*) remain connected to the network 120.

FIGS. 2 through 15 depict views of a manual alarm pull station 200 and components thereof employed as one of the Building Devices 130*a-n* in the building system of FIG. 1A in which various embodiments of the present disclosure are implemented. Although an alarm pull station is shown and described herein, aspects and features of the disclosed alarm pull station may be embodied on other Building Devices 130*a-n* and 132*a-n*.

The alarm pull station 200 comprises a mounting base 202 having a mounting surface 204 for mounting or installing the pull station 200 on a wall or other structure of a building. The alarm pull station 200 includes a cover 206 that functions as an actuator cover for the pull station 200. In the embodiment shown in FIG. 2, the cover 206 is in sliding engagement with the mounting base 202 and biased by a biasing device (e.g., 602 in FIG. 6) of an actuator switch (e.g. 402 in FIG. 6) in cooperation with a rotatable cam (e.g. 404 in FIG. 6) to cooperatively retain the alarm pull station 200 in a normal state. As further described in detail herein, a person may exert a pre-determined downward force on the cover 206 to counter the bias of the biasing device 602 and cause the alarm pull station 200 to switch to an alarm state as shown in FIG. 3. Moreover, a person such as a facility administrator, may insert a key (not shown in figures) into a keyed slot (e.g. 502 in FIG. 5) of a lock mechanism (e.g. 504 in FIG. 5) employed in the cam assembly (e.g. 500 in FIG. 5) and turn the key to rotate the cam 404 to a position as shown in FIG. 4, enabling the cover 206 to be removed in cooperation with the biasing device 602 of the actuator switch 402 and causing the alarm pull station 200 to switch to a maintenance state.

The cover has an external surface 405 and an internal surface 406 that define a cavity 407 there between. The cavity 407 may function as a user hand grip of the cover 206 to enable a person to pulldown the cover to actuate the alarm pull station to switch to the alarm state.

Returning to FIG. 2, the alarm pull station 200 may include a door 208 that is coupled to the cover 206 to provide a two-stage actuation for the pull station 200. In this embodiment, the door 208 is configured to be selectively pushed into the cavity 407 formed in the cover 206 by a person before the person applies the downward force on the cover 206 to counter the bias of the biasing device 602 and trigger the alarm pull station to switch to the alarm state as shown in FIG. 3.

Turning again to FIG. 4, a front perspective view of the manual alarm pull station 200 is shown, where the alarm pull station 200 is in a maintenance state with the actuator cover 206 removed from the mounting base 202 and connector channels 408 and 409 of an address programming interface 410 of the alarm pull station are accessible from the front of the mounting base 202. In FIG. 4, the address programming interface 410 is shown in dashed block to reflect that the address programming interface that includes the connector channels 408 and 409 may be a component of the alarm pull station that is attached to the rear of the base 202 and/or integral to the base 202 as described in further detail herein. The connector channels 408 and 409 are defined by a front surface 418 of the mounting base 202 and extend towards a rear surface (1202 in FIG. 12) of the mounting base 202. The first connector channel 408 and the second connector channel 409 are spaced apart and sized to each receive a respective prong (1402 or 1404 in FIG. 14) of a connector plug (1406 in FIG. 14) attached to a programming device. As described in further detail herein, the connector channels 408 and 409 may extend between the front and the rear surfaces 418 and 1202 of the mounting base such that the first and the second connector channels 408 and 409 may each receive a respective prong of the connector plug 1406 from either the front or the rear surfaces 418 and 1202 of the mounting base.

In embodiments disclosed herein, the base 202 includes one or more tabs 412*a*, 412*b*, 412*c*, and 412*d* extending from the base 202. The tabs 412*a*, 412*b*, 412*c*, and 412*d* may extend from left side and right side walls 414 and 416 of the base 202 or may be a bracket extending from the front surface 418 of the base 202 such as the L-shaped brackets shown in FIG. 4.

The cover 206 includes one or more flanges 420*a*, 420*b*, 420*c*, and 420*d* disposed about the cover to slidingly engage the tabs 412*a*, 412*b*, 412*c*, and 412*d* on the base to selectively retain the cover to the mounting base 202. In one embodiment, one or more (or each) of the flanges 420*a*, 420*b*, 420*c*, and 420*d* has a respective stop element 422*a*, 422*b*, 422*c*, and 422*d* disposed such that, when a predetermined downward force is exerted on the cover 206 that counters the bias of the biasing device (e.g., 602 in FIG. 6), each of the one or more flanges 422*a*, 422*b*, 422*c*, and 422*d* of the cover 206 slides downward relative to the tab of the mounting base 202 until the corresponding tab 412*a*, 412*b*, 412*c*, and 412*d* engages the stop element 422*a*, 422*b*, 422*c*, and 422*d* of the respective flange 420*a*, 420*b*, 420*c*, and 420*d*. Stop elements 422*a* and 422*c* of the flanges 420*a* and 420*c* are not in view in the figures but may have structure consistent with stop elements 422*b* and 422*c* of the flanges 420*b* and 420*d* shown in FIG. 4.

Figure 2:
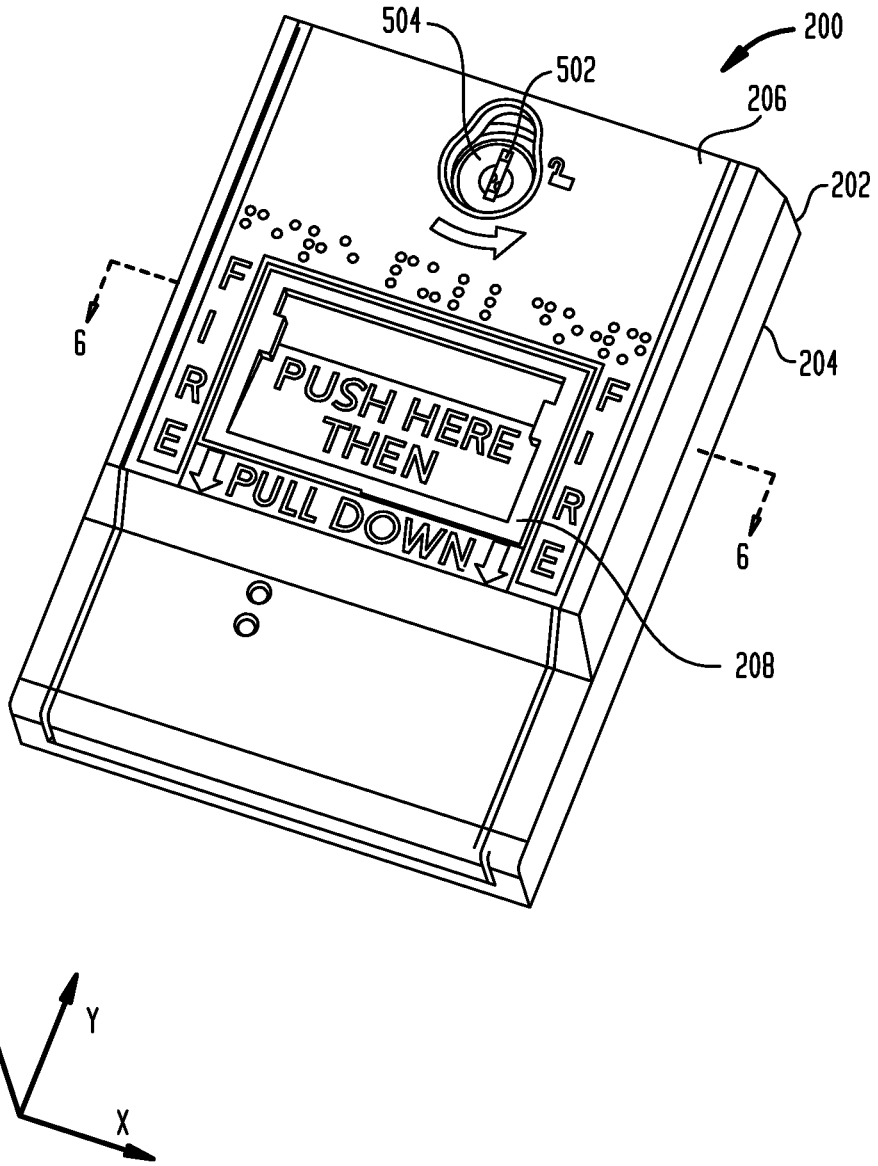
FIG. 2 illustrates a front perspective view of a manual alarm pull station employed in the building system of FIG. 1A or 1B and in which various embodiments of the present disclosure are implemented, where the alarm pull station is depicted in a normal state.
Figure 3:
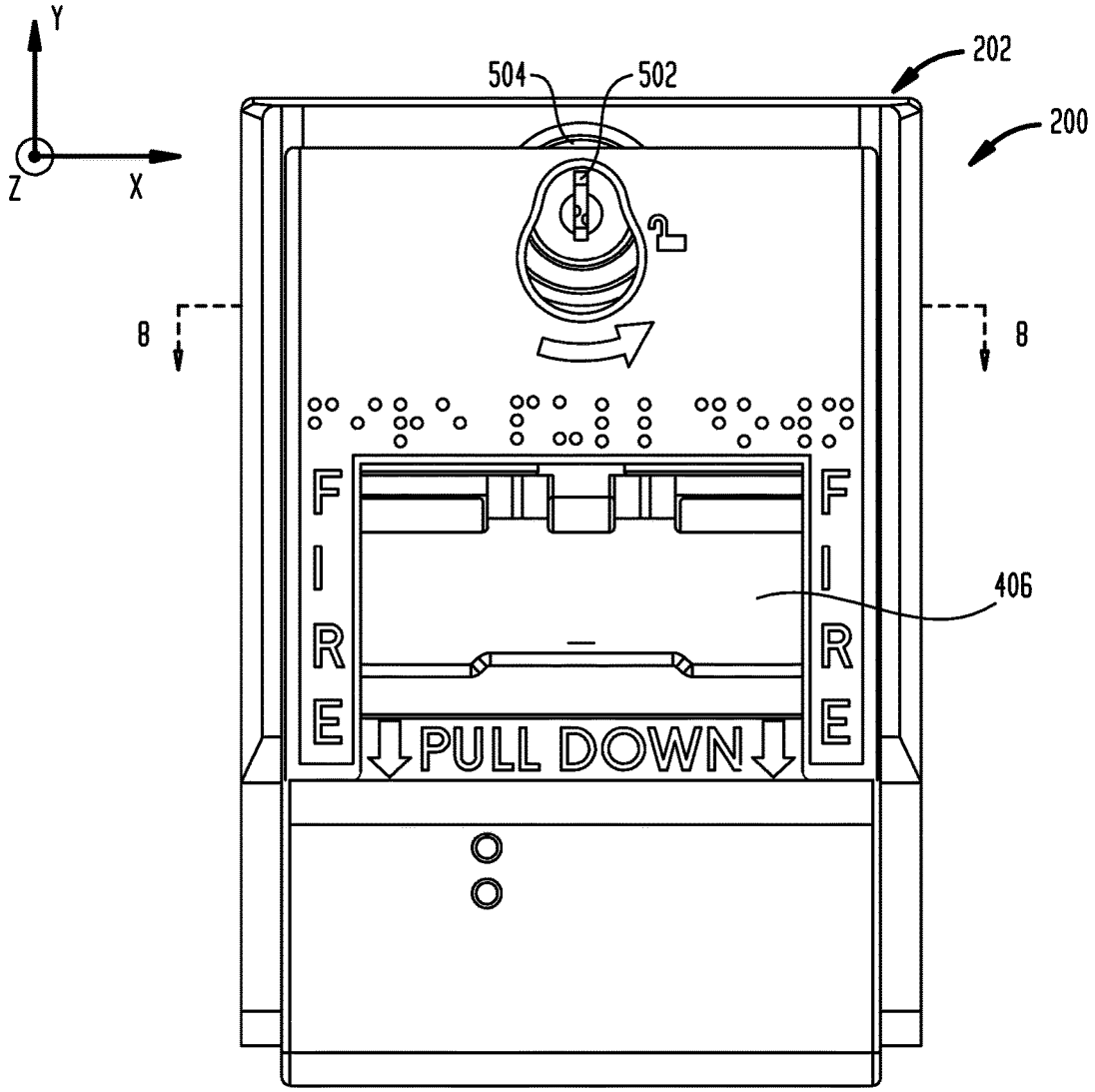
FIG. 3 illustrates a front view of the manual alarm pull station of FIG. 2, where the alarm pull station is depicted in an alarm state.
Figure 4:
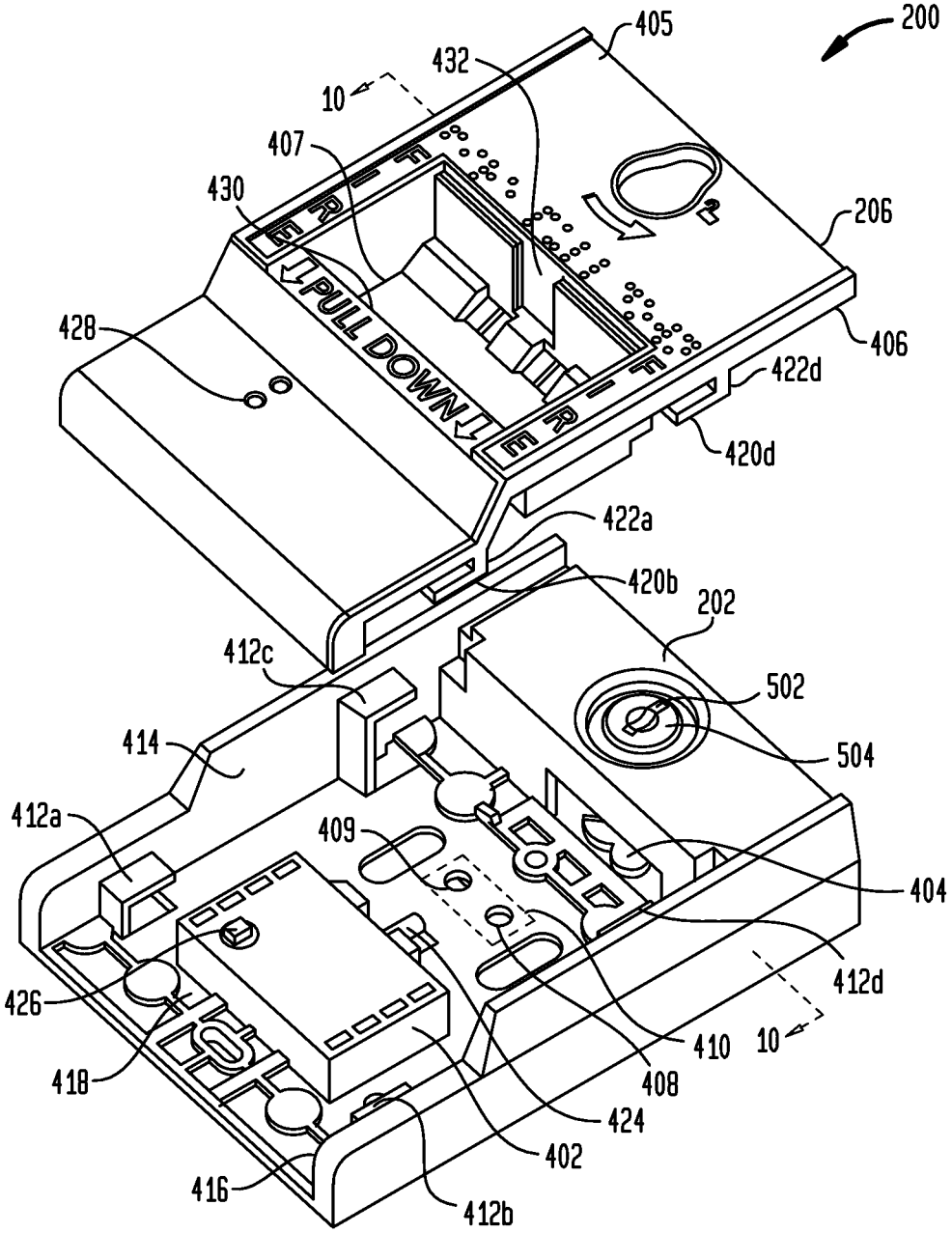
FIG. 4 illustrates a front perspective view of the manual alarm pull station of FIG. 2, where the alarm pull station is depicted in a maintenance state in accordance with the removal of an actuator cover from a mounting base of the alarm pull station and connector channels of an address programming interface of the alarm pull station are shown for front access.

In FIGS. 2-4, a three axis ("x", "y" and "z") coordinate system is shown in relationship to the alarm pull station 200. In this coordinate system, the mounting surface 204 of the mounting base 202 forms a plane parallel to or in the "x" and "y" axis plane, and the cam 404 of the cam assembly 504 is rotatable to a plurality of pre-determined cam positions about an axis "z" that is substantially perpendicular to the mounting surface 204.

Figure 12:
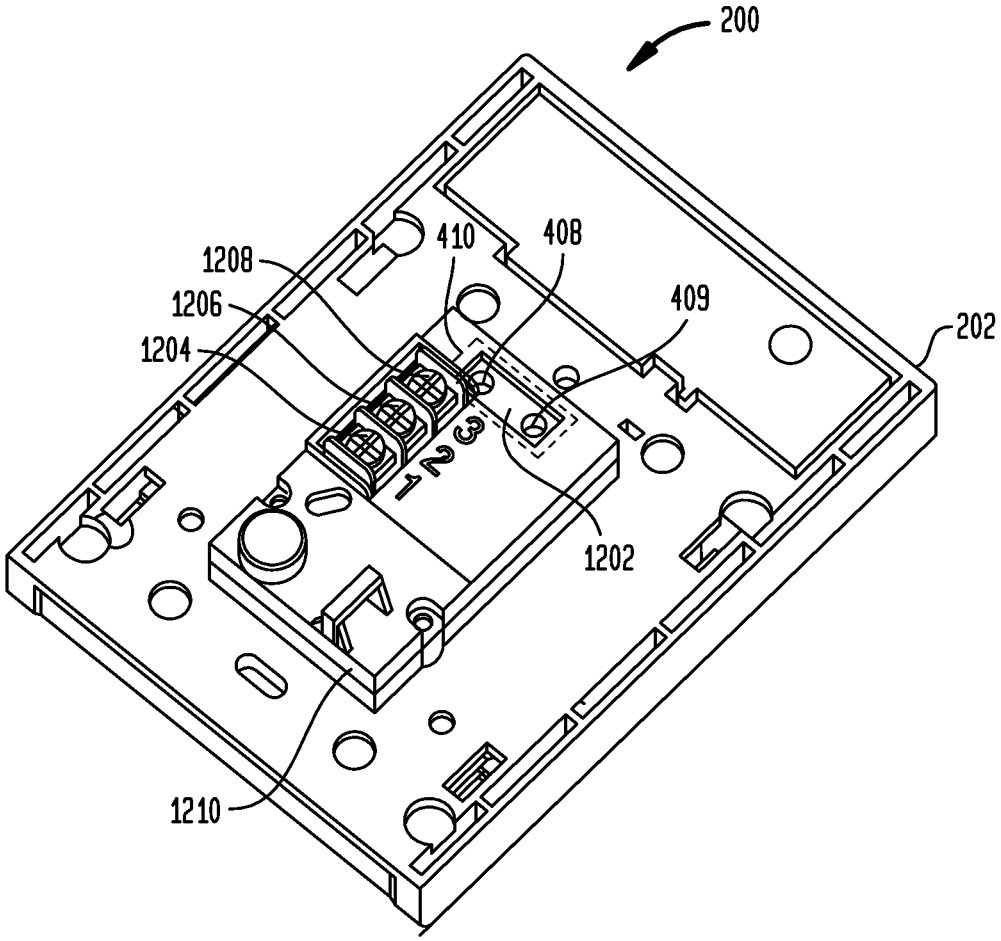
FIG. 12 illustrates a back perspective view of the manual alarm pull station of FIG. 1, where the connector channels of the address programming interface of the alarm pull station are shown for rear access.

In one embodiment, the actuator switch 402 is disposed and attached to the base 202 (directly or via control circuit board 1212 as depicted in FIG. 12) at a location below the cam assembly 504 and below the cavity 407 of the cover 206 when the cover 206 is selectively in sliding engagement with the base 202 of the alarm pull station 200. The actuator switch 402 has a plunger 424 and a status indicator 426 that is disposed to be viewable through a corresponding status window or opening 428 in the cover. As described in further detail herein, the biasing device 602 of the actuator switch 402 is coupled to the plunger 424 to bias the plunger 424 in a direction towards the cam 404.

Figure 5:
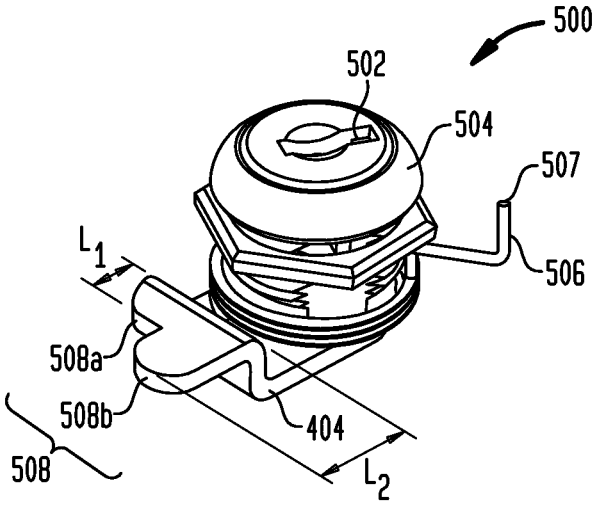
FIG. 5 illustrates a cam assembly of the manual alarm pull station of FIG. 2.

Turning to FIG. 5, a cam assembly 500 that may be employed in the manual alarm pull station 200 is shown. The cam assembly 500 includes the lock mechanism 504 having the keyed slot 502. The cam assembly 500 also includes a rotational biasing device 506 such as a torsion spring that has an end 507 attached to the base 202. The rotational biasing device 506 biases the cam 404 to rotate in a first rotational direction (e.g., clock wise direction) about the axis "z" that is perpendicular to the mounting surface 204 of the base 202 when the cam assembly 500 is installed in or on the base 202. The keyed slot 502 of the lock mechanism 504 is configured to receive a corresponding key and configured to rotate the cam 404 in a second rotational direction opposite (e.g., counter clock wise direction) to the first rotational direction when the key is received in the keyed slot 502 and turned in the second rotational direction. The lock mechanism 504 is configured to selectively lock the cam 404 in one of the pre-determined cam positions (e.g., the third cam position) when the key is received in the keyed slot 502 and turned in the second rotational direction.

In one embodiment, the cam has an end 508 that has a first portion 506*a* having a first length ($L_1$) and a second portion 506*b* having a second length ($L_2$) that is longer than the first length ($L_1$). As disclosed herein, the first portion 506*a* engages an upper protuberance (604 in FIG. 6) or upper inner edge (606 in FIG. 6) of the cover 206 formed by cavity 407 when the cam 404 is in a first of the pre-determined cam positions (i.e., first cam position depicted in FIG. 6) corresponding to the normal state of the alarm pull station 200 and the second portion engages the upper protuberance 604 or upper inner edge 606 of the cover 206 when the cam is in a second of the pre-determined cam positions (i.e., the second cam position depicted in FIG. 8) corresponding to the alarm state of the alarm pull station 200.

Figure 6:
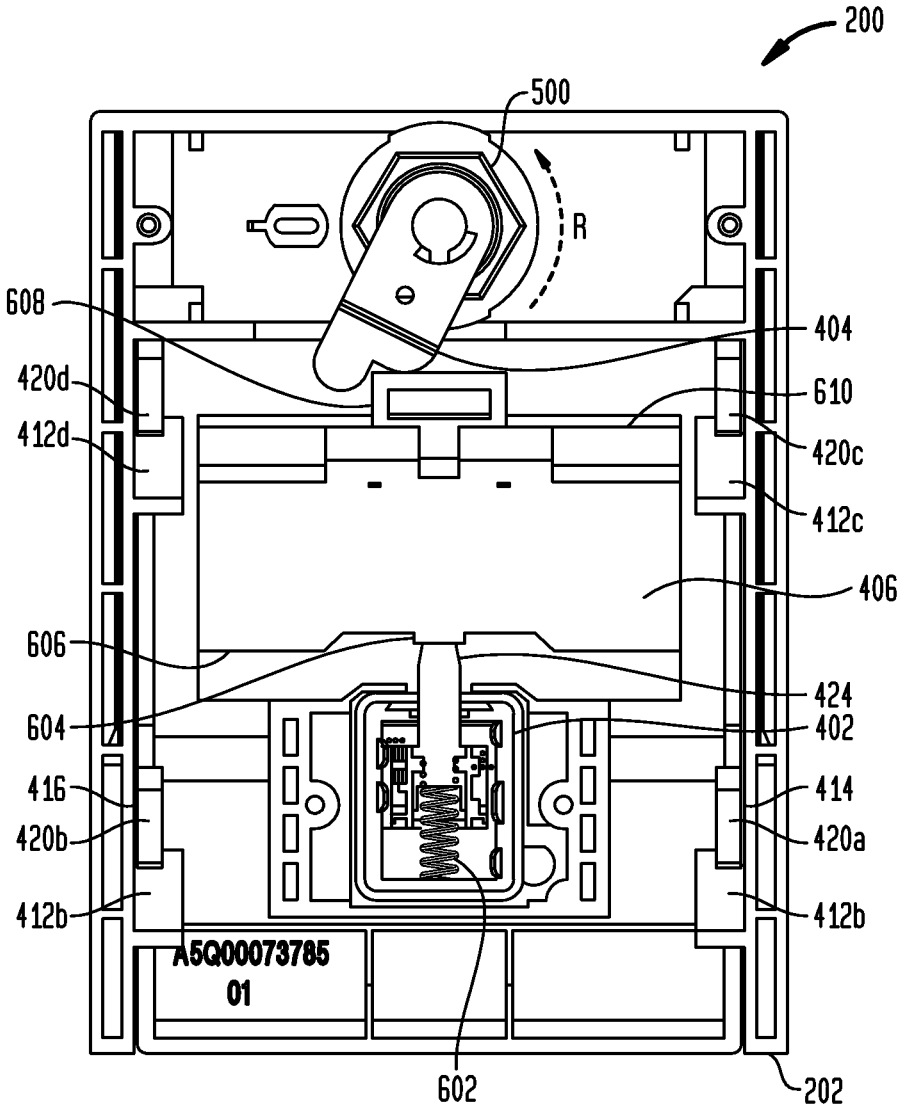
FIG. 6 illustrates a back, sectional view of the manual alarm pull station taken along the line 6-6 of FIG. 2 when the alarm pull station is in the normal state, where a cam of the cam assembly is rotated to a first cam position and a plunger of a actuator switch of the alarm pull station is in a first pre-determined plunger position corresponding to the normal state.
Figure 8:
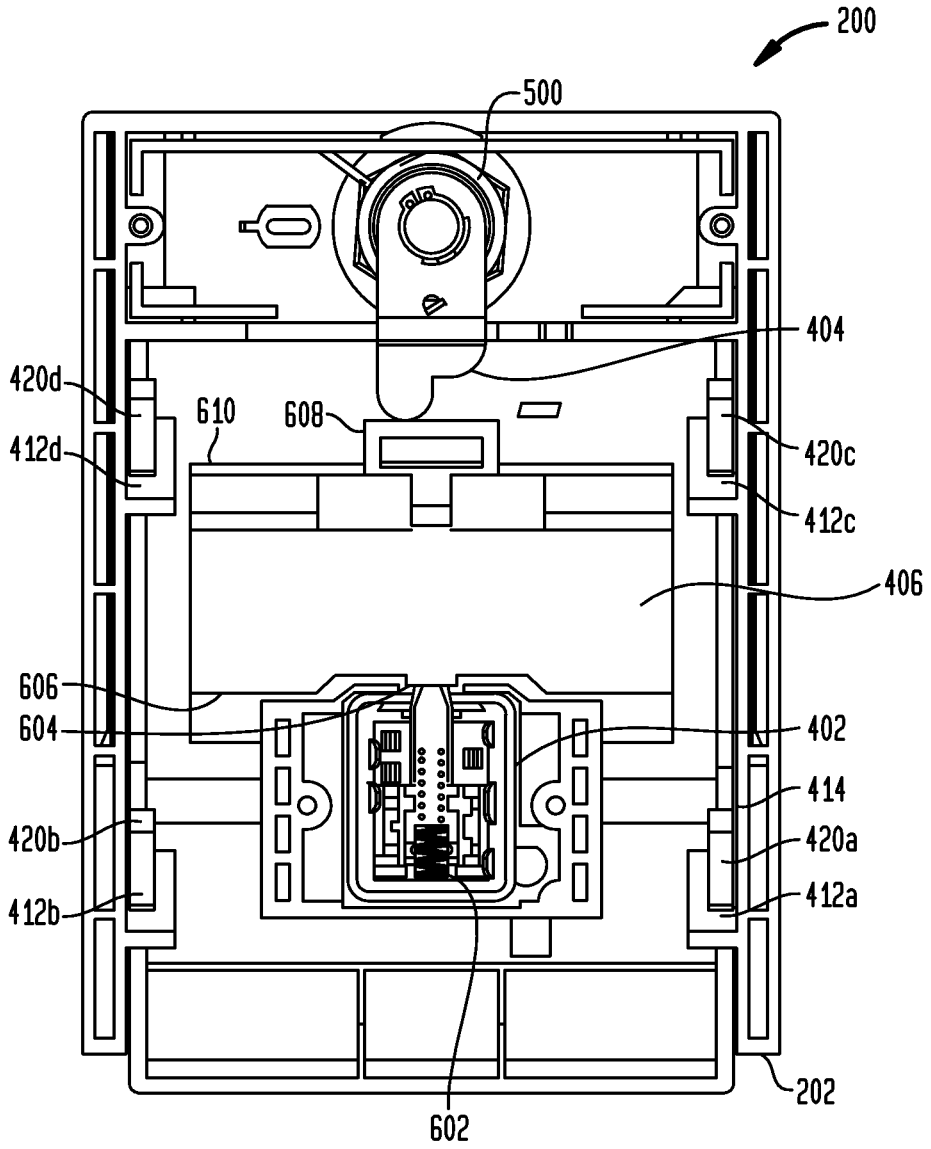
FIG. 8 illustrates a back, sectional view of the manual alarm pull station taken along the line 8-8 of FIG. 3 when the alarm pull station is in the alarm state, where the cam is rotated to a second cam position and the plunger of the actuator switch is in a second pre-determined plunger position corresponding to the alarm state.

Turning to FIG. 6, a back, sectional view of the manual alarm pull station 200 is shown taken along the line 6-6 of the pull station as depicted in FIG. 2 when the alarm pull station is in the normal state. As shown in FIG. 6 and other figures, the cover 206 has a lower protuberance 604 extending from the lower inner edge 606 of the cover 206 defined by a lower wall (430 best viewed in FIG. 4) of the cavity 407 and an upper protuberance 608 disposed above the lower protuberance 604 and extending from the upper inner edge 610 of the cover 206 defined by an upper wall (432 best viewed in FIG. 4) of the cavity 407. The lower protuberance 604 (or the lower inner edge 606 itself) of the cover 206 selectively engages the plunger 424 to bias the cover 206 in a direction towards the cam 404. The upper protuberance 608 (or the upper inner edge 610 itself) of the cover 206 selectively engages the cam 404 when the cam 404 is rotated (via the rotational biasing device or key mechanism) to the first cam position as shown in FIG. 6 or to the second cam position as shown in FIG. 8. One or more of the flanges 422*a*, 422*b*, 422*c*, and 422*d* are disposed on the cover 206 to slidingly engage respective a respective one of the tabs 412*a*, 412*b*, 412*c*, and 412*d* on the base 202 to selectively retain the cover 206 to the mounting base 202 in cooperation with the plunger 424 biasing the lower protuberance 604 of the cover 206 and the cam 404 engaging the upper protuberance 608 of the cover 206.

To place the alarm pull station in the normal state as shown in FIGS. 2 and 6, a key may first be inserted into the key slot 502 and turned such that the cam 404 is rotated to the third cam position or other position away from the plunger 424 to enable insertion of the cover 206. The cover 206 is positioned between and aligned with the left side wall 414 and right side wall 416 of the base 202 and moved downward until the lower protuberance 604 or the lower inner edge 606 of the cover 206 engages the plunger 424. The biasing device 602 of the actuator switch 402 is coupled to the plunger 424 to normally bias the plunger 424 in a direction towards the cam 404. Therefore, to place the alarm pull station in the normal state, a person applies a downward force on the cover 206 to counter the bias of the biasing device 602 on the plunger 424 and compress the biasing device 602 with the plunger to move the cover 206 downward until the flanges 422*a*, 422*b*, 422*c*, and 422*d* of the cover 206 capture or engage the tabs 412*a*, 412*b*, 412*c*, and 412*d* of the base 202. At this point, the cam 404 is rotated to the first cam position as shown in FIG. 6 and the counter bias downward force on the cover 206 is removed. Once the counter bias downward force is removed, the biasing device 602 biases the plunger 424 upward to correspondingly move the cover 206 while engaging the lower protuberance 604 of the cover 206 until the lower portion 508*a* of the end of the cam 404 engages the upper protuberance 608 or upper inner edge 610 of the cover 206. While the cover 206 is moved upward, the flanges 422*a*, 422*b*, 422*c*, and 422*d* of the cover 206 remain in sliding engagement with the tabs 412*a*, 412*b*, 412*c*, and 412*d* of the base 202 to retain the cover 206 to the base 202. Accordingly, when in the normal state, the cam 404 is rotated to the first cam position and the plunger 424 of the actuator switch 402 is in a first pre-determined plunger position corresponding to the normal state such that the cam 404 in cooperation with the biasing device 602 of the actuator switch 402 biasing the plunger 424 to enable the cover 206 to be selectively retained in sliding engagement to the base 202.

Figure 7:
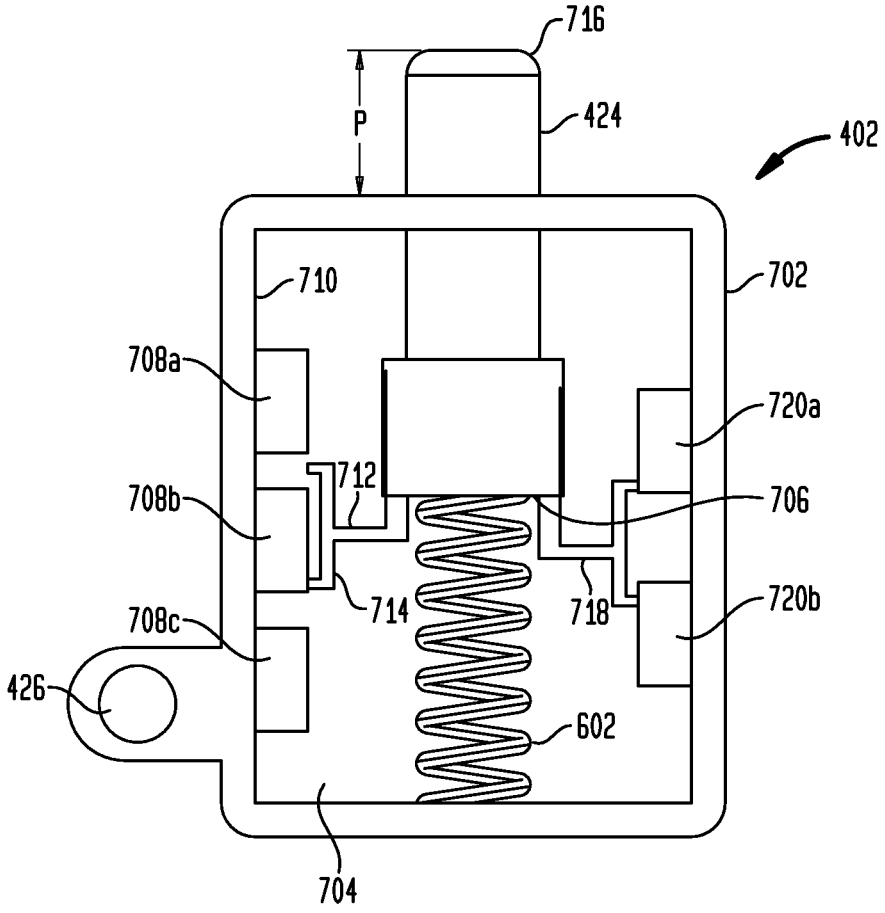
FIG. 7 illustrates an expanded view of the actuator switch as depicted in FIG. 6 where the plunger of the actuator switch is biased to the first pre-determined plunger position corresponding to the normal state.

FIG. 7 illustrates an expanded view of the actuator switch 402 with the plunger 424 biased to the first pre-determined plunger position corresponding to the normal state of the alarm pull station 200 as depicted in FIG. 6. The actuator switch 402 has a body 702 to which the biasing device 602 is attached at one end. As shown in FIG. 7, the body 702 may define an internal chamber 702 in which the biasing device 602 is disposed and attached. The plunger 424 has an inner end 706 attached to the biasing device 602. The actuator switch 402 also has a plurality of contacts 708*a*, 708*b* and 708*c* disposed on the body 702 along a path (P) corresponding to a direction of movement of the plunger 424. As shown in FIG. 17, the contacts 708*a*, 708*b* and 708*c* may be disposed along an inner wall 710 of the chamber 704.

The actuator switch 402 further includes a conductor arm 712 attached to the inner end 706 of the plunger 724. The conductor arm 712 is disposed in relation to the contacts 708*a*, 708*b* and 708*c* such that the conductor arm 712 connects to one or more of the contacts 708*a*, 708*b* and 708*c* when the plunger 424 is moved to a respective one of the a plurality of pre-determined plunger positions. The conductor arm 712 has a contact end 714 that is sized to connect to one or simultaneously to two of the contacts 708*a*, 708*b* and 708*c* when the plunger 424 is moved to a respective one of the plurality the pre-determined plunger positions. The conductor arm 712 or at least the contact end 714 of the conductor arm may be comprised of any metal, metal alloy, or material that has electrical conductor properties.

As shown in FIGS. 6 and 7, the plunger 424 has an external end 716 that the lower protuberance 604 or lower inner edge 606 of the cover 206 selectively engages to bias the cover 206 in a direction towards the cam 404. When the lower protuberance 604 or lower inner edge 606 of the cover 206 engages the external end 714 of the plunger 424 and the cam 404 is rotated to the first cam position as shown in FIG. 6, the cam 404 (or the lower portion 508*a* of the end of the cam 404) biases the upper protuberance 608 or upper inner edge 610 of the cover 206 to retain the plunger 424 in the first of the pre-determined plunger positions corresponding to the normal state for the alarm pull station.

Figure 9:
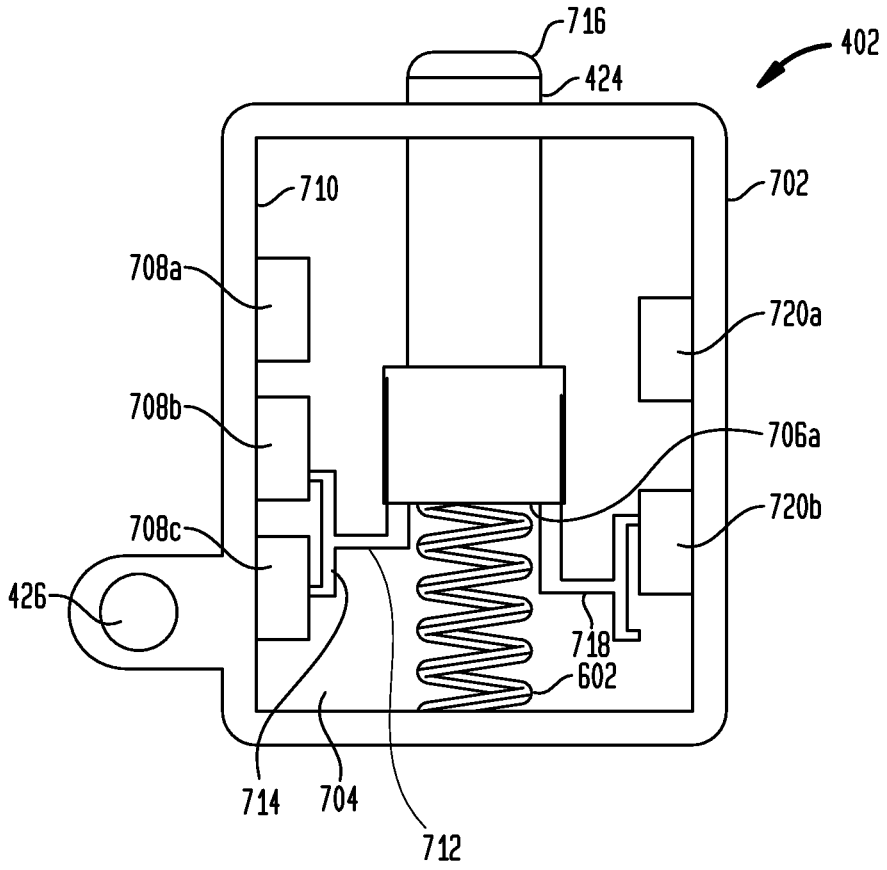
FIG. 9 illustrates an expanded view of the actuator switch as depicted in FIG. 8 where the plunger of the actuator switch is biased to the second pre-determined plunger position corresponding to the alarm state.
Figure 10:
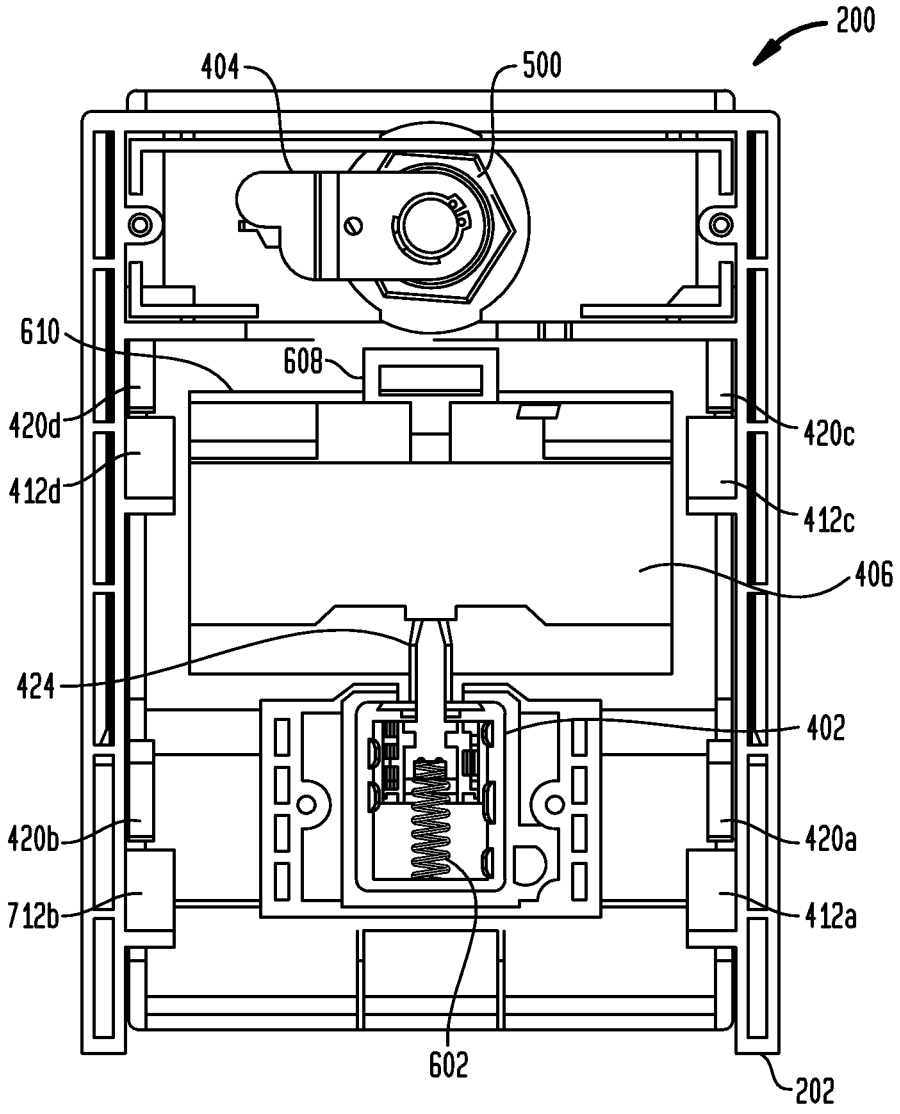
FIG. 10 illustrates a back, sectional view of the manual alarm pull station taken along the line 10-10 of FIG. 4 when the alarm pull station is in the maintenance state, where the cam is rotated to a third cam position and the plunger of the actuator switch is in a third pre-determined plunger position corresponding to the maintenance state to enable the cover to be removed.
Figure 11:
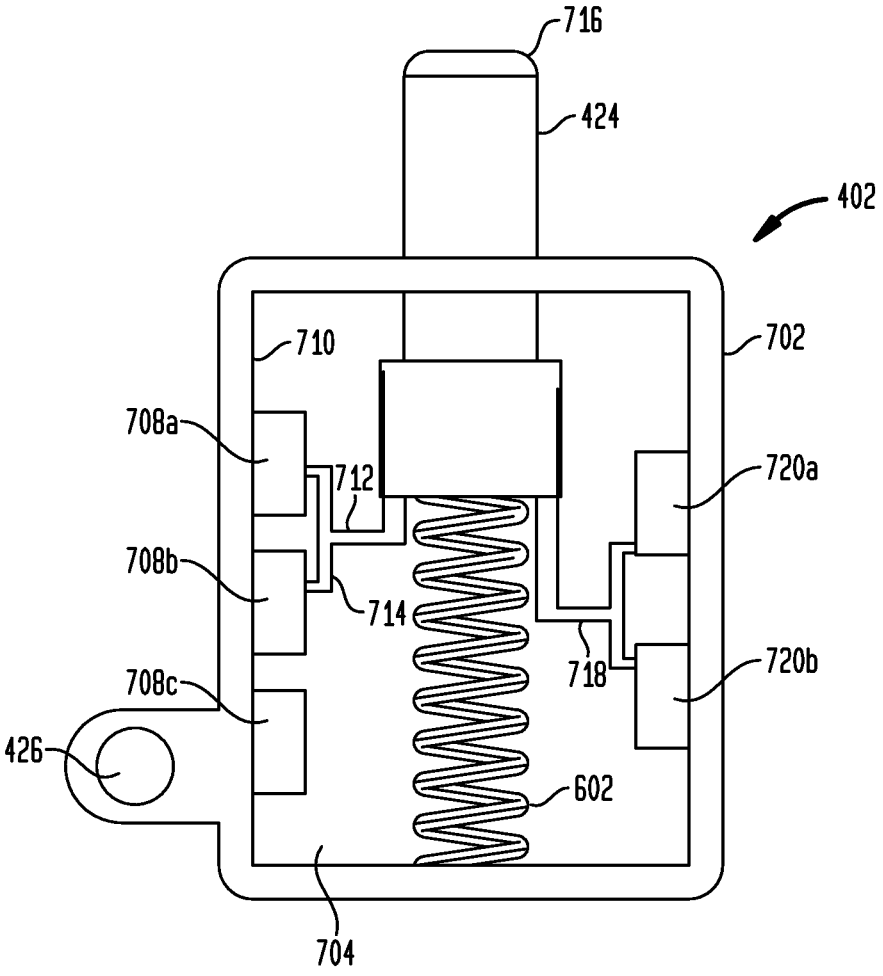
FIG. 11 illustrates an expanded view of the actuator switch as depicted in FIG. 10 where the plunger of the actuator switch is biased to the third pre-determined plunger position corresponding to the maintenance state.

When the plunger 424 is in the first of the pre-determined plunger positions, the conductor arm 712 contacts at least or only the second 708*b* of the plurality of contacts to signal the normal state for the alarm pull station 200. As shown in FIGS. 8 and 9, when the plunger 424 is in the second of the pre-determined plunger positions, the conductor arm 712 contacts the second contact 708*b* and the third contact 708*c* to signal the alarm state for the alarm pull station 200. As shown in FIGS. 10 and 11, when the plunger 424 is in the third of the pre-determined plunger positions, the conductor arm 712 contacts the first contact 708*a* and the second contact 708*b* to signal the maintenance state for the alarm pull station 200.

Figure 13:
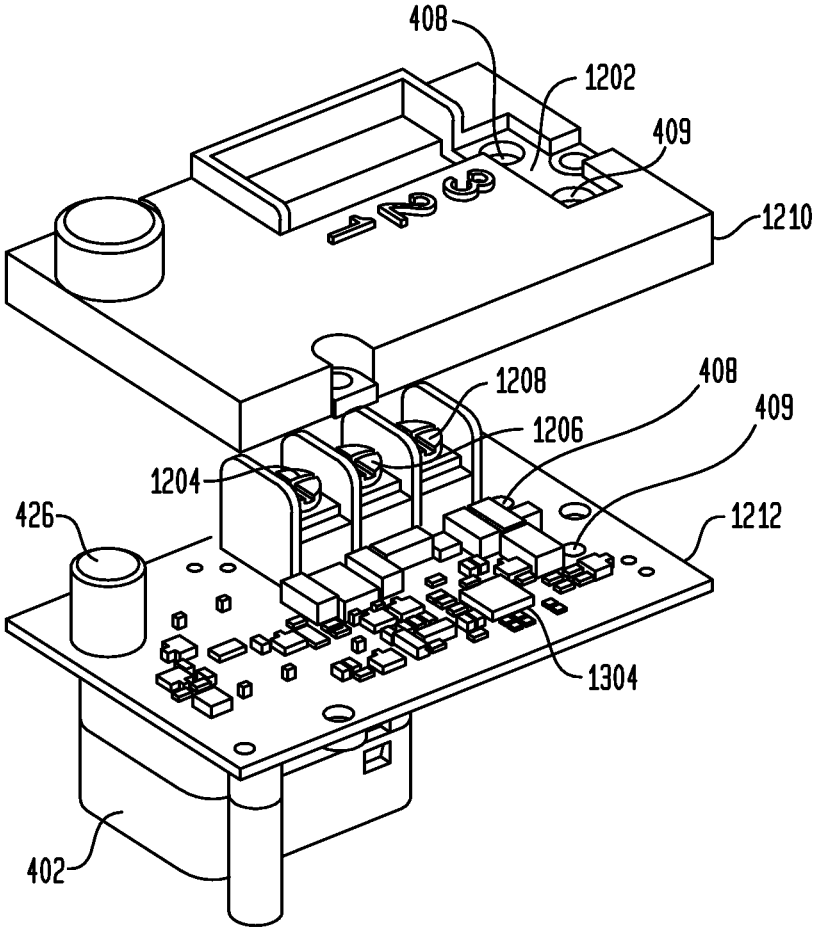
FIG. 13 illustrates a back perspective view of the actuator switch coupled to a control circuit board of the alarm pull station, where a microprocessor of the control circuit is shown operatively coupled to the address programming interface and the connector channels.

As further described herein, the alarm pull station 200 has a microprocessor (1304 in FIG. 13) that is operatively connected to each of the contacts 708*a*, 708*b* and 708*c*. The microprocessor 1304 in FIG. 13 is operatively configured to detect when the conductor arm 712 is only connected to one of the contacts 708*a*, 708*b* or 708*c* (e.g., only the second contact 708*b* as shown in FIG. 7) to signal when the actuator switch 402 has been switched to identify the normal state of the alarm pull station 200. The microprocessor 1304 is also operatively configured to detect when the conductor arm 712 is simultaneously connected to both of the first and second contacts 708*a* and 708*b* to signal when the actuator switch 402 has been switched to a state corresponding to the maintenance state of the alarm pull station 200. The microprocessor 1304 in FIG. 13 is also operatively configured to detect when the conductor arm 712 is simultaneously connected to both the second contact 708*b* and the third contact 708*c* to signal when the actuator switch 402 has been switched to identify the alarm state of the alarm pull station 200.

However, the actuator switch 402 and microprocessor 1304 as disclosed in the embodiments may be employed in other Building Devices where the microprocessor 1304 is operatively configured to detect the conductor arm 712 of the actuator switch 402 connecting to one or simultaneously to two of the contacts 708*a*, 708*b* and 708*c* when the plunger 424 of the actuator switch 402 is moved to a respective one of the a plurality of pre-determined plunger positions to signal a corresponding state for the Building Device.

The status indicator 426 of the actuator switch 402 may be a multicolored lamp or LED array to display the current state of the actuator switch 402 based on the connection of the conductor arm 712 to one or simultaneously to two of the contacts 708*a*, 708*b* and 708*c* where each state is reflected with a different color lamp or LED. In one implementation, the microprocessor 1304 may be operatively connected to the status indicator 426 of the actuator switch 402 to cause the status indicator 426 to display a different color corresponding to the detected signal from the contacts 708*a*, 708*b* and 708*c* reflecting the connection of the conductor arm 712 to one or simultaneously to two of the contacts 708*a*, 708*b* and 708*c*.

The actuator switch 402 may include a second conductor arm 718 attached to the external end 716 to the plunger 424 and a second plurality of contacts 720*a* and 720*b* disposed on the body 702 along a path (P) corresponding to a direction of movement of the plunger 424. The second conductor arm 718 is disposed in relation to the contacts 720*a* and 720*b* such that the second conductor arm 712 simultaneously connects to the contacts 720*a* and 720*b* is moved to a respective one of the a plurality of pre-determined plunger positions corresponding to an auxiliary state or condition of the actuator switch 402 or the alarm pull station 200.

When the plunger 424 is in the first of the pre-determined plunger positions as shown in FIGS. 6 and 7 and a pre-determined downward force is exerted on the cover 206 to exceed the bias of the biasing device 602 on the plunger 424, the one or more flanges 420*a*, 420*b*, 420*c*, and 420*d* of the cover 206 slide downward relative to the corresponding tabs 412*a*, 412*b*, 412*c*, and 412*d* while retaining the cover 206 to the mounting base 202 and the cam 404 rotates from the first cam position (as depicted in FIG. 6) to the second cam position (as depicted in FIG. 8) based on the rotational biasing device 506. When the second cam position is reached, the lock mechanism 504 has a lever to selectively engage and lock the cam 404 in the second cam position.

When in the second cam position as shown in FIGS. 8 and 9, the cam 404 (or the upper portion 508*b* of the end of the cam 404) biases the upper protuberance 608 or the upper inner edge 610 of the cover 206 to retain the plunger 424 in a second of the pre-determined plunger positions corresponding to the alarm state for the alarm pull station. As previously described herein, when the plunger 424 is in the second of the pre-determined plunger positions, the conductor arm 712 that is attached to the inner end of the plunger 424 contacts the second and a third contacts 708*b* and 708*c* to signal the alarm state for the alarm pull station.

As shown in FIG. 10, the cam 404 is selectively rotatable to a third cam position away from the upper protuberance 608 and upper inner edge 610 of the cover 206 where the cam 404 does not engage either the upper protuberance 608 or the upper inner edge 610 to remove the cam's downward counter bias on the plunger 424 and the biasing device 602 of the actuator switch 402. When the cam 404 is in the third cam position, the biasing device 602 biases the plunger 424 upward to a third of the pre-determined plunger positions as shown in FIG. 11 corresponding to the maintenance state for the alarm pull station 202 and the plunger 424 correspondingly moves the cover 206 a pre-determined distance towards the cam 404 such that each flange 420*a*, 420*b*, 420*c*, and 420*d* is no longer slidingly engaged to the corresponding tabs 412*a*, 412*b*, 412*c*, and 412*d* on the base 202 and the cover 206 is removable from the base 202 as shown in FIGS. 2 and 10. When the plunger 424 is in the third of the pre-determined plunger positions as depicted in FIG. 11 and previously described herein, the conductor arm 712 contacts the first and the second contacts 708*a* and 708*b* to signal the maintenance state for the alarm pull station.

When the cover 206 is removed and the alarm pull station 200 is in the maintenance state in accordance with the embodiments disclosed herein, a person such as a facility administrator can advantageously access the address programming interface 410 from the front of the mounting base 202 without having to remove and disconnect the mounting base 202 from the network 120 connection to the system controller 150. However, if the alarm pull station 200 or other Building Device employing the disclosed address programming interface 410 has not yet been installed on a wall or structure of the building, then the address programming interface 410 may be accessed from the rear of the mounting base 202 as shown in FIG. 12.

FIG. 12 illustrates a back perspective view of the alarm pull station 200, where the first and second connector channels 408 and 409 of the address programming interface 410 of the alarm pull station 200 are shown for rear access. FIG. 13 illustrates a back perspective view of the actuator switch 402 coupled to a control circuit board 1212 of the alarm pull station. The microprocessor 1304 of the alarm pull station 200 is disposed on the control circuit board 1212 and is a component of the control circuit thereon such that the microprocessor 1304 is shown operatively coupled to the address programming interface 410 and the connector channels 408 and 409.

As shown in FIGS. 12 and 13, the alarm pull station 200 has a plurality of external terminals 1204, 1206 and 1208 disposed on the rear surface 1202 of the mounting base 202. In one implementation as shown in FIG. 12, the rear surface 1202 of the mounting base 202 may be the rear surface of an extension housing 1210 for a control circuit board 1212 of the mounting base 202. The connector channels 408 and 409 extend from the front surface 418 of the base through the control circuit board 1212 to the rear surface 1210 of the mounting base 202 or the extension housing 1210 of the mounting base 202.

Depending on the operational mode that the alarm pull station 200 is to implement (e.g., isolator operational mode or polarity insensitive operational mode), the communication lines 140 and 142 of the network 120 may be connected to a different pair of the three external terminals 1204, 1206, and 1208 of the base 202 prior to installation of the base 202 to a wall or structure of the building.

When operating in the isolator operational mode, the communication lines 140 and 142 of the network 120 from the system controller 112 or previous Building Device may be connected to a first pair of the external terminals corresponding to the first and third external terminals 1204 and 1208 of the base 202. The other or second external terminal 1206 is wired to the first external terminal 1204 of the next Building Device on the network 120 to enable the first communication line 140 to be selectively connected internally between the respective pull station 200 or Building Device to the next Building Device or to be selectively connected to the first terminal 1204 via a isolator switch 1436 or 1536 to isolate the respective pull station 200 or Building Device from the network 120. When connected to the external terminals 1204, 1206 and 1208, the communication lines 140 and 142 are switched via the address programming interface 410 for connection to corresponding plurality of internal terminals of the alarm pull station 200 as described herein.

When operating in the polarity insensitive operational mode, the communication lines 140 and 142 of the network 120 may be connected a second or different pair of the external terminals corresponding to first and second external terminals 1204 and 1206 of the base 202 prior to installation of the base 202 to a wall or structure of the building. When operating in the polarity insensitive operational mode, the third external terminal 1208 may remain unused or a third wire for another input/output or axillary signal for the alarm pull station 200 may be connected to the third external terminal 1208. When connected to the external terminals 1204, 1206 and 1208, the communication lines 140 and 142 as well as the axillary signal are switched via the address programming interface 410 for connection to corresponding plurality of internal terminals of the alarm pull station 200 as described herein.

Figure 14:
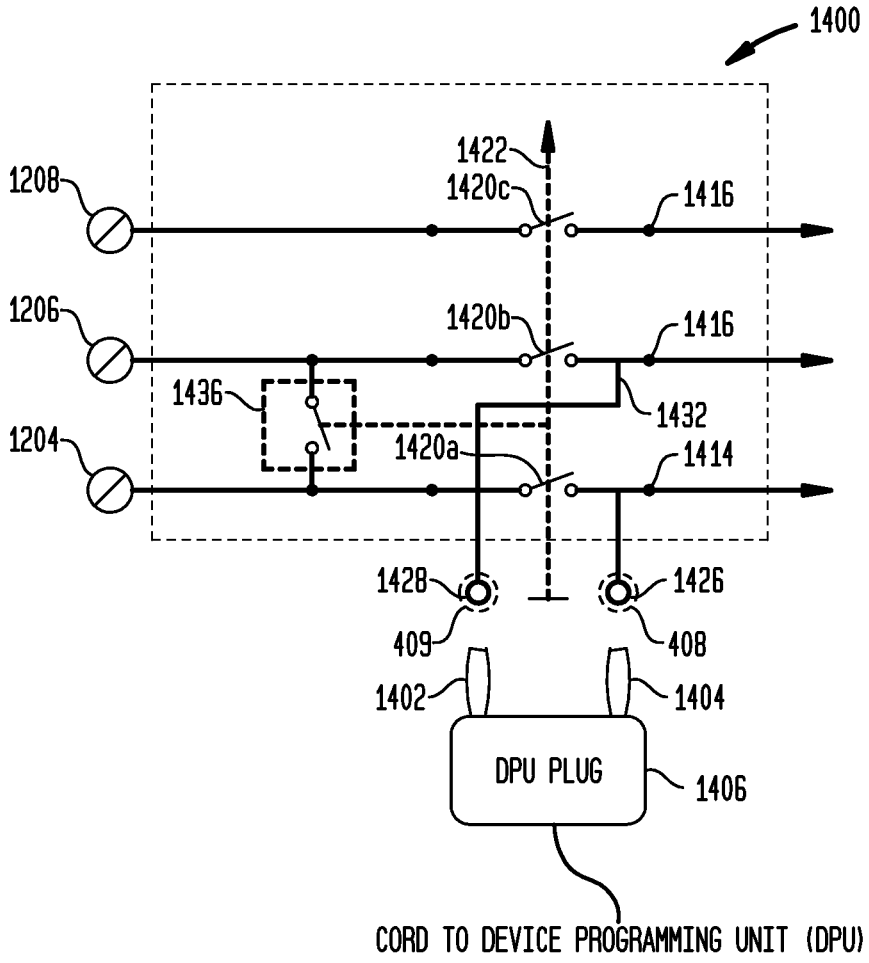
FIG. 14 illustrates a block schematic of one embodiment of the address programming interface that may be employed in the alarm pull station or other building device.
Figure 15:
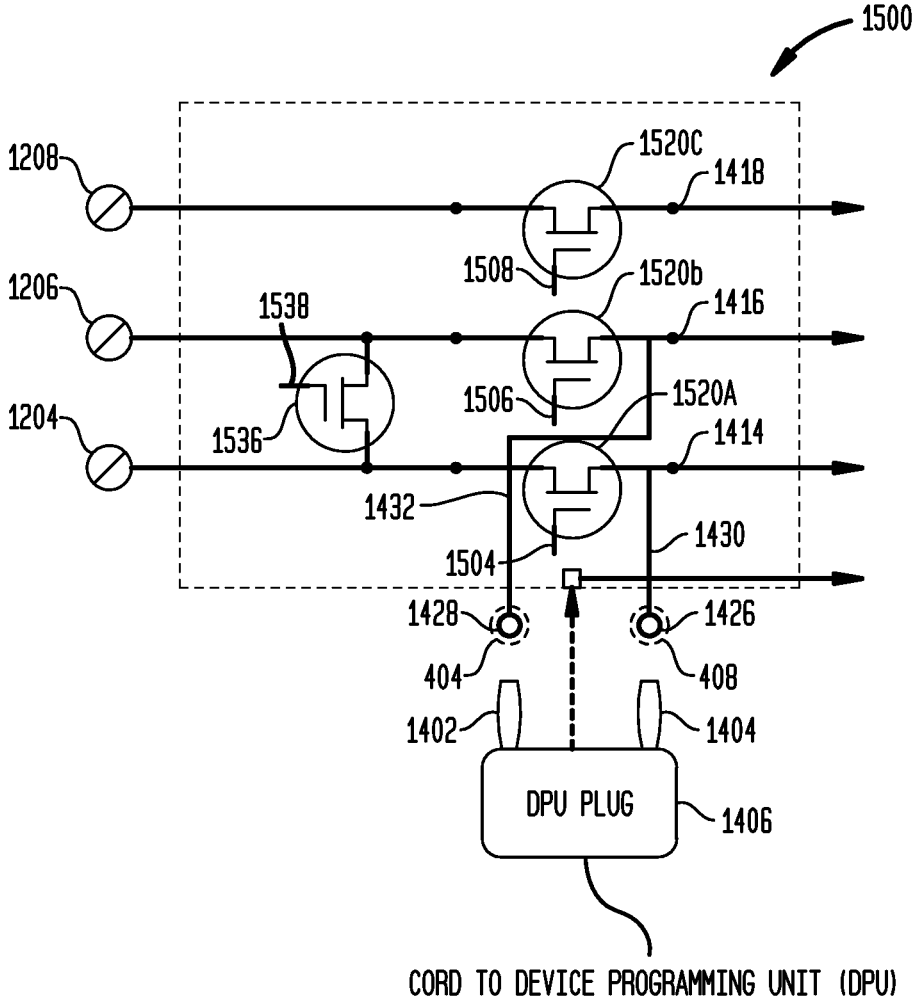
FIG. 15 illustrates a block schematic of another embodiment of the address programming interface that may be employed in the alarm pull station or other building device.

Embodiments 1400 and 1500 of the address programming interface 410 of the alarm pull station 200 are depicted in FIGS. 14 and 15 that enables the alarm pull station 200 (or any Building Device employing such address programming interface) to be programmed via a device programming unit (DPU) from the front or back of the alarm pull station 200 or Building Device.

As shown in FIG. 14, the alarm pull station 200 or Building Device employing the address programming interface 1400 includes a plurality of internal terminals 1414, 1416 and 1418. The alarm pull station or Building Device also includes a first plurality of normally closed switches 1420*a*, 1420*b* and 1420*c* having a common control input 1422. Each switch 1420*a*, 1420*b* and 1420*c* of the first plurality of switches 1420*a*, 1420*b* and 1420*c* connects a respective one of the external terminals 1204, 1206 and 1208 to a respective one of the internal terminals 1414, 1416 and 1418 when the common control input 1422 is deactivated. The alarm pull station 200 or Building Device employing the address programming interface 1400 further includes an actuator 1424 connected to the common control input 1422 and disposed in proximity of the connector channels 408 and 409 such that the connector plug 1406 engages the actuator 1424 to activate the common control input 1422 of the first plurality of normally closed switches 1420*a*, 1420*b* and 1420*c* when the first and the second connector channels 408 and 409 each receive a respective prong 1402 and 1404 of the connector plug 1422. In this implementation of the address programming interface 1400, the actuator 1424 may be a paddle switch, slide switch or other mechanical actuator that has a mechanical or electrical output connected to the common control input 1422.

As shown in FIG. 14, each of the internal terminals 1414 and 1416 (that may be switched via corresponding switches 1420*a* and 1420*b* to corresponding external terminals 1204 and 1206 to connect to communication lines 140 and 142) has a contact 1426 or 1428 disposed within a respective one of the first and second connector channels 408 and 409 such that each prong 1402 and 1404 of the connector plug 1406 electrically connects to the contact 1426 or 1428 of one of the internal terminals 1414 or 1416 when received by the respective one of the first and second connector channels 408 and 409. In the implementation shown in FIG. 14, each of the contacts 1426 and 1428 disposed with the connector channels 408 and 409 is connected to a corresponding internal terminal 1414 or 1416 via an internal wire lead 1430 or 1430 disposed on or within the control circuit board 1212.

As previously noted, a pair of the external terminals 1204, 1206 and 1208 are each connected to respective network communication line 140 or 142. For example, when configured for isolator operational mode, the communication lines 140 and 142 are connected to a first pair corresponding to the first and third external terminals 1204 and 1208 of the base 202. When configured for polarity insensitive operational mode, the communication lines 140 and 142 are connected to a second or different pair corresponding to the first and second external terminals 1204 and 1206 of the base 202.

The alarm pull station 200 or Building Device employing the address programming interface 1400 may further comprise a normally open switch 1436 that has an activation input 1438 connected to the common control input 1422 of the first plurality of switches 1420*a*, 1420*b* and 1420*c*. When activated, the normally open switch 1436 selectively connects the first and second external terminals 1204 and 1206 to form a network communication line bypass of the alarm pull station 200 or Building Device employing the address programming interface 1400. In one implementation, the normally open switch 1436 is employed by the alarm pull station 200 or Building Device when configured for isolator operational mode. In this implementation, the activation input 1438 of the normally open switch 1436 may be connected to the common control input 1422 via the controller 1304 such that the controller 1304 enables the activation input 1438 of the normally open switch 1436 by the common control input 1422 of the first plurality of switches 1420*a*, 1420*b* and 1420*c* when the alarm pull station 200 or Building Device is in the isolator operational mode.

The address programming interface 1500 depicted in FIG. 15 may also be employed in the alarm pull station or other Building Device. The address programming interface 1500 is consistent with the embodiment of the address programming interface 1400 in FIG. 14. For example, the alarm pull station 200 or Building Device employing the address programming interface 1500 includes a plurality of internal terminals 1414, 1416 and 1418 and a first plurality of normally closed switches. However, in the embodiment shown in FIG. 15, the first plurality of normally closed switches 1520*a*, 1520*b* and 1520*c* are solid state switch devices such as a transistor or FET type switches that have a respective gate 1504, 1506 or 1508 connected to a common control input 1522 either directly or via the microprocessor 1304. As shown in FIG. 15, each switch 1520*a*, 1520*b* and 1520*c* connects a respective one of the external terminals 1204, 1206 and 1208 to a respective one of the internal terminals 1414, 1416 and 1418 when the common control input 1522 is deactivated to drive the gate 1504, 1506 and 1508 to close the respective switch 1520*a*, 1520*b* and 1520*c*. The alarm pull station 200 or Building Device employing the address programming interface 1500 further includes an electronic or non-mechanical contact 1550 that is disposed in proximity to the connector channels 408 and 409 such that the contact 1550 may engage a corresponding contact 1552 disposed on the plug 1406 when the prongs 1402 and 1404 of the plug 1406 are received by or inserted into the connector channels 408 and 409. The microprocessor 1304 is operatively connected to and adapted to detect the engagement of the contacts 1550 and 1552 and to deactivate the common control input 1522 and drive the gates 1504, 1506 and 1508 to close the respective switch 1520*a*, 1520*b* and 1520*c* when the prongs 1402 and 1404 are received by or inserted into the connector channels 408 and 409. Thus, in the implementation shown in FIG. 15, the contact 1550 disposed in proximity to the connector channels 408 and 409 functions in combination with the microprocessor 1034 as an electronic actuator for the address programming interface 1500. In an alternative embodiment, one of the contacts 1426 or 1428 disposed in the connector channels 408 and 409 may be employed as an electronic actuator that is operatively connected and monitored by the microprocessor 1304 to detect when a corresponding prong 1402 or 1404 of the plug 1406 of the device programming unit engages the respective contact 1426 or 1428 (i.e., detects a short) and, upon detecting such engagement, triggers the common control input 1522 to close the switches 1520*a*, 1520*b* and 1520*c*.

The alarm pull station 200 or Building Device employing the address programming interface 1500 may also comprise a normally open solid state switch 1536 that has an activation gate input 1538 connected to the common control input 1522 of the first plurality of solid state switches 1520*a*, 1520*b* and 1520*c*. When activated, the normally open switch 1536 selectively connects the first and second external terminals 1204 and 1206 to form a network communication line bypass of the alarm pull station 200 or Building Device employing the address programming interface 1500. In one implementation, the normally open solid state switch 1536 is employed by the alarm pull station 200 or Building Device when configured for isolator operational mode. In this implementation, the activation gate input 1538 of the normally open switch 1536 may be connected to the common control input 1522 via the controller 1304 such that the controller 1304 enables the activation gate input 1538 of the normally open switch 1536 by the common control input 1522 of the first plurality of switches 1520*a*, 1520*b* and 1520*c* when the alarm pull station 200 or Building Device is in the isolator operational mode.

Thus, disclosed embodiments provide distinct technical advantages over present systems. In particular, the address programming interfaces 410, 1400, or 1500 disclosed here advantageously enable the alarm pull station 200 or Building Device employing the address programming interface 410, 1400, or 1500 to be programmed with a network address without having to manually disconnect the alarm pull station 200 or Building Device from the network 120 by disconnecting the communication lines 140 and 142 from the external terminals 1204 and 1206. This advantage is achieved by the address programming interface 410, 1400 or 1500 by inserting the prongs 1402 and 1404 of the plug 1406 of the device programming unit into the connector channels 408 and 409 from either the front or rear of the alarm pull station 200 or Building Device employing the address programming interface 410, 1400 or 1500.

Those skilled in the art will recognize that, for simplicity and clarity, the full structure and operation of all building systems and building devices (such as manual pull stations) suitable for use with the present disclosure is not being depicted or described herein. Instead, only so much of a building system and building device as is unique to the present disclosure or necessary for an understanding of the present disclosure is depicted and described. The remainder of the construction and operation of building systems 100 and 100' and building devices such as manual pull station 200 may conform to any of the various current implementations and practices known in the art.

It is important to note that while the disclosure includes a description in the context of a fully functional system, those skilled in the art will appreciate that at least portions of the mechanism of the present disclosure are capable of being distributed in the form of instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable mediums include: nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs).

Although exemplary embodiments of the present disclosure have been described in detail, those skilled in the art will understand that various changes, substitutions, variations, and improvements disclosed herein may be made without departing from the spirit and scope of the disclosure in its broadest form.

None of the description in the present application should be read as implying that any particular element, step, or function is an essential element which must be included in the claim scope: the scope of patented subject matter is defined only by the allowed claims. Moreover, none of these claims are intended to invoke paragraph six of 35 USC § 112 unless the exact words "means for" are followed by a participle.

What is claimed is:

1. A building device, comprising:

a mounting base having a front surface and a rear surface, the front surface defining a plurality of connector channels extending towards the rear surface, a first and a second of the connector channels spaced apart and sized to each receive a respective prong of a connector plug attached to a programming device;

a plurality of external terminals disposed on the rear surface of the mounting base;

a plurality of internal terminals;

a first plurality of normally closed switches having a common control input, each switch of the first plurality of switches connecting a respective one of the external terminals to a respective one of the internal terminals when the common control input is deactivated; and an actuator connected to the common control input and disposed in proximity of the connector channels such that the connector plug engages the actuator to activate the common control input of the first plurality of normally closed switches when the first and the second connector channels each receive a respective prong of the connector plug.

2. The building device of claim 1, wherein each of the internal terminals has a corresponding contact disposed within a respective one of the first and second connector channels such that each prong of the connector plug electrically connects to the contact of one of the internal terminals when received by the respective one of the first and second connector channels.

3. The building device of claim 2, further comprising a control circuit board disposed in or on the mounting base, wherein each contact disposed within the respective connector channel is connected to the corresponding internal terminal via an internal wire lead disposed on or within the control circuit board.

4. The building device of claim 2, wherein the building device further comprises a normally open switch having an activation input connected to the common control input of the first plurality of switches, wherein, when activated, the normally open switch selectively connects a first and a second of the external terminals to form a network communication line bypass of the building device.

5. The building device of claim 4, further comprising a controller, wherein the activation input of the normally open switch is connected to the common control input via the controller and the controller enables the activation input of the normally open switch by the common control input of the first plurality of switches when the building device is in an isolator operational mode.

6. The building device of claim 1, wherein the connector channels extend between the first and the second surfaces of the mounting base and the actuator is disposed such that the connector plug engages the actuator when the first and the second connector channels each receive a respective prong of the connector plug from either the front or the rear surfaces of the mounting base.

7. The building device of claim 1, wherein the actuator is a paddle switch that has a mechanical or electrical output connected to the common control input.

8. The building device of claim 1, wherein the actuator is a slide switch that has a mechanical or electrical output connected to the common control input.

9. The building device of claim 1, wherein the first plurality of normally closed switches are solid state switch devices that have a respective gate operatively connected to the common control input.

10. The building device of claim 1, further comprising a controller and a first contact operatively connected to the controller, wherein the contact is disposed in proximity to the connector channels such that the contact engages a corresponding second contact disposed on the connector plug when the prongs of the plug are received by the connector channels, and the controller is operatively configured to detect the engagement of the first and second contacts.

11. The building device of claim 10, wherein upon detecting the engagement of the first and second contacts, the controller deactivates the common control input to close the respective switches.

12. The building device of claim 1, further comprising a controller, wherein:

each of the internal terminals has a corresponding contact disposed within a respective one of the first and second connector channels such that each prong of the connector plug electrically connects to the contact of one of the internal terminals when received by the respective one of the first and second connector channels; and the controller is operatively connected to at least one of the contacts disposed within the connector channels, detects when the respective prong of the connector plug engages the at least one contact and, upon detecting such engagement, and triggers the common control input.

13. The building device of claim 1, wherein the building device is an alarm pull station having a removable actuator cover.

* * * * *